United States Patent [19]

Cypser

[11] 3,995,125

[45] Nov. 30, 1976

[54] PROTECTIVE GRILLE

[75] Inventor: Hugo F. Cypser, Long Branch, N.J.

[73] Assignee: Wheelock Signals, Inc., Long Branch, N.J.

[22] Filed: June 30, 1975

[21] Appl. No.: 591,719

[52] U.S. Cl. ..... 179/184

[51] Int. Cl.[2] ..... H04R 1/02

[58] Field of Search ..... 179/184, 179, 178, 187, 179/1 E; 325/352; 181/199; 312/7 R

[56] References Cited

UNITED STATES PATENTS

| | | | |
|---|---|---|---|
| 2,490,563 | 12/1949 | Van Gastle | 179/179 X |
| 3,909,530 | 9/1975 | Gosswiller | 179/1 E |

FOREIGN PATENTS OR APPLICATIONS

| | | | |
|---|---|---|---|
| 705,549 | 3/1954 | United Kingdom | 179/184 |

*Primary Examiner*—Thomas W. Brown
*Attorney, Agent, or Firm*—Brumbaugh, Graves, Donohue & Raymond

[57] ABSTRACT

A grille for protecting a loudspeaker or the like comprises two substantially identical parts, each part being formed with bars defining a plurality of openings. When the two parts are placed together in back-to-back and head-to-toe relation, the openings in one part are out of register with the openings in the other part. This provides a plurality of circuitous paths through the grille for the passage of sound or the like, but there are no straight-line paths through the grille for the passage of vandalizing implements or the like.

7 Claims, 4 Drawing Figures

PROTECTIVE GRILLE

BACKGROUND OF THE INVENTION

This invention relates to protective grilles and, more particularly, to a novel and highly-effective grille for protecting a loudspeaker or the like, especially one used to signal the existence of an emergency such as fire.

In order to save life and property during a fire or other emergency, it is of the utmost importance to have a reliable audible alarm. Experience has shown that one requirement for reliability is protection of the loudspeaker or other signaling device against weather and vandalism, and fire codes generally require such protection.

Conventionally, sometimes a re-entrant loudspeaker is used to give an alarm: i.e., a loudspeaker that is folded within itself. This folding not only reduces its physical length but also provides a certain measure of protection. In some cases, the speaker cone opens in a direction opposite the direction in which the alarm signal is intended mainly to be propagated, and the sound waves emanating from the speaker cone are reflected from the baffle or reflector mounted in front of the cone and pass around the loudspeaker in the direction of principal propagation. See, for example, the woofer assembly, FIG. 20–57C, *The Audio Cyclopedia*, Second Edition, 1973, page 1100. In other cases, the horn is doubly folded, and the speaker cone opens in a direction which is the same as the direction in which the alarm signal is intended mainly to be propagated. The sound waves emanating from the speaker cone and passing through an interior horn are then reflected from a baffle or reflector mounted in front of the interior horn, pass around the interior horn in a direction opposite the direction in which the alarm signal is intended mainly to be propagated, and are then reflected by an exterior horn and propagated mainly in the intended direction, which is the same as the direction in which the cone opens. See, for example, the tweeter assembly, FIG. 20–57C, and the exponential folded horn, FIG. 20–57B, *The Audio Cyclopedia*, 2nd Edition, 1973, page 1100.

Such re-entrant speakers are deficient in a numer of respects. First, they are more expensive than conventional speakers that are not folded. Second, they do not necessarily protect against vandalism, since it is often possible to reach around the speaker cone and damage it.

Accordingly, a grille is sometimes used to protect the speaker cone, and in this case the horn may, but need not, be folded. Grilles are known that permit sound to pass through while excluding rain, vandalizing implements and the like. One example is used in the Model 950 loudspeaker of Federal Sign and Signal Corporation. However, conventional grilles are relatively expensive to manufacture, since it is necessary to construct louvers which lie in separate planes that are perpendicular to the principal propagation axis of the sound waves. Making such louvers in one piece is relatively expensive. Making them in two pieces that can be assembled is often less expensive but is nevertheless costly because separate tooling is required to manufacture the two pieces, since they are different. See, for example, the Model 950 mentioned above and the inner and outer rows of bars of the grille 22 shown in the patent to Walker U.S. Pat. No. 3,306,990 for "Microphone and Speaker Structure for Miniature Receiver and Transmitter", issued Feb. 28, 1967.

SUMMARY OF THE INVENTION

An object of the invention is to remedy the problems of conventional loudspeakers and protective grilles outlined above. In particular, an object of the invention is to provide a protective grille that readily permits the passage of sound or the like but excludes rain, vandalizing implements and the like. Another object of the invention is to provide a protective grille that can be manufactured less expensively than conventional grilles, that is easy to install in its housing, and that is aesthetically pleasing.

The foregoing and other objects are attained in accordance with the invention by the provision of a grille for protecting a loudspeaker or the like comprising two parts, each part being formed with obstruction means defining a plurality of openings. The structure is such that, when the two parts are placed together in back-to-back and head-to-toe relation, the openings in one part are out of register with the openings in the other part. This provides a plurality of circuitous paths through the grille for the passage of sound or the like. However, there is no straight-line path through the grille for the passage of vandalizing implements or the like. In accordance with the invention, the two parts are characterized in that they are substantially identical.

In a preferred embodiment of the invention, each part comprises a plurality of bars that are substantially straight in a direction across the face of the grille and that are substantially U-shaped in cross section. One and only one leg of a U of one part abuts one and only one leg of a U of the other part. This defines a plurality of overlapping S curves. The S curves slope out and down to shed rain and the like.

Housing means is provided for the grille, together with fastening means for attaching the grille to the housing means and spacer means inserted around the fastening means between the grille and the housing means. The spacer means is preferably made of a non-resilient material such as phenolic resin.

BRIEF DESCRIPTION OF THE DRAWING

A better understanding of the invention can be gained from a consideration of the following detailed description of the preferred embodiments thereof in conjunction with the appended figures of the drawing, wherein.

DESCRIPTION OF THE PREFERRED EMBODIMENTS

Figure 1:
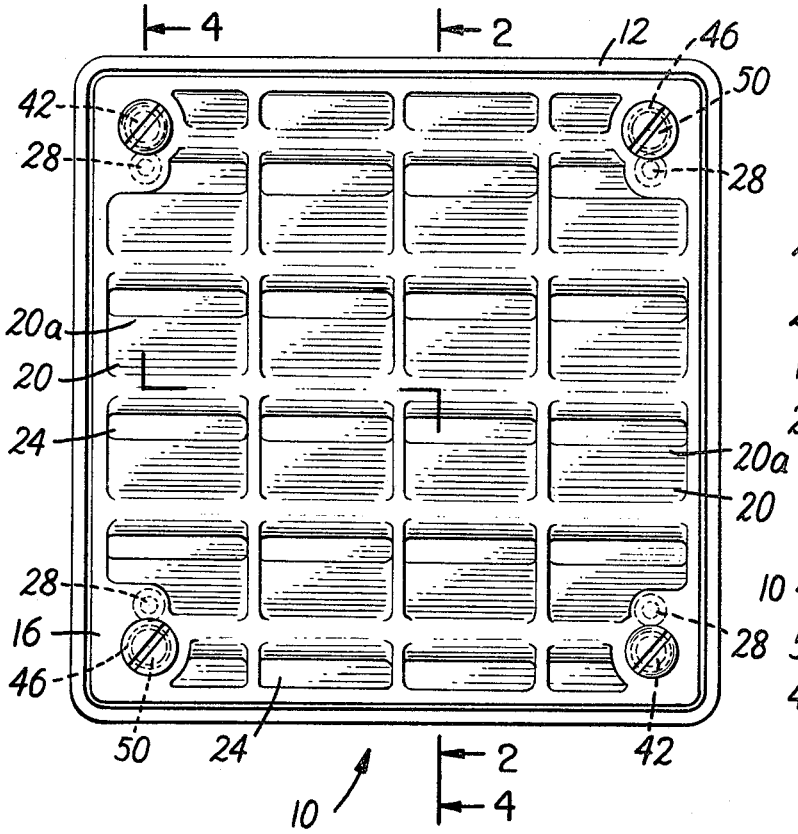
FIG. 1 is a view in elevation of a preferred embodiment of a protective grille constructed in accordance with the invention.
Figure 2:
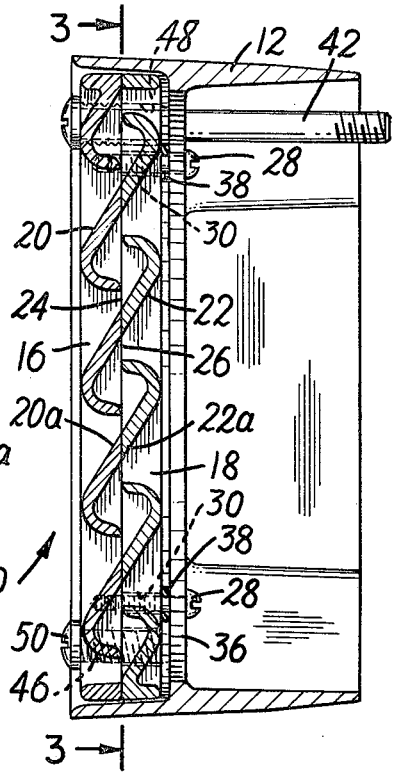
FIG. 2 is a sectional view of the grille of FIG. 1 taken along the line 2—2 of FIG. 1 and looking in the direction of the arrows.
Figure 3:
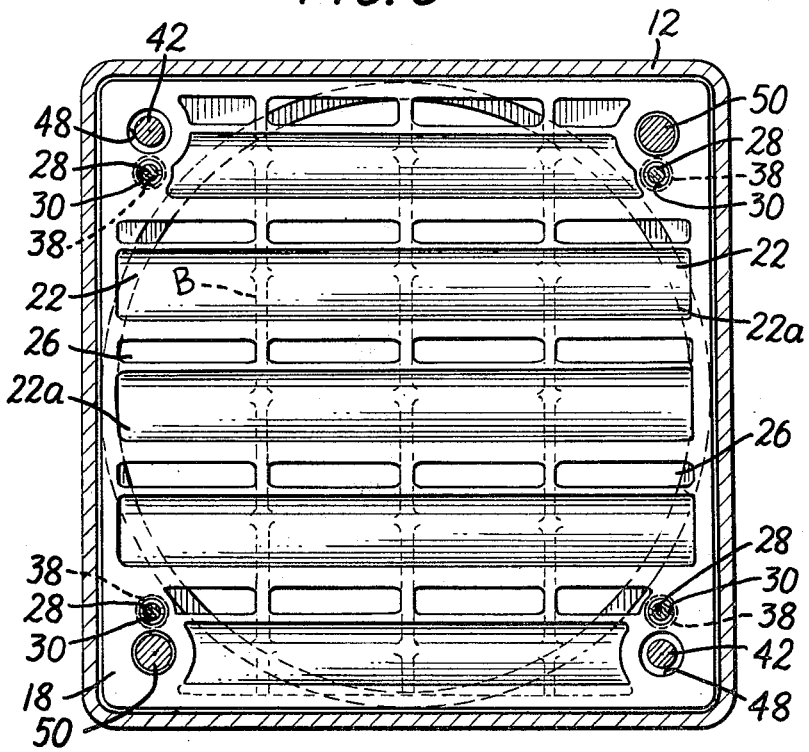
FIG. 3 is a sectional view of the grille taken along the line 3—3 of FIG. 2 and looling in the direction of the arrows.
Figure 4:
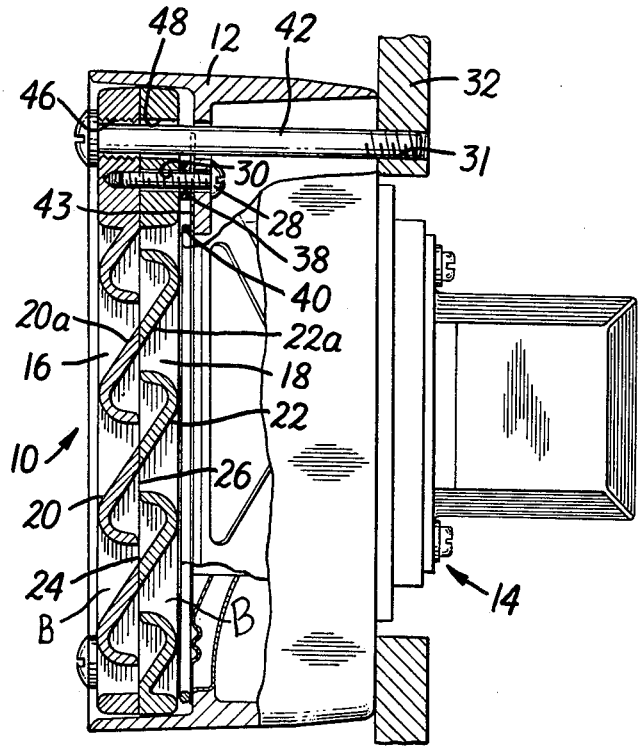
FIG. 4 is a sectional view of the grille taken along the broken line 4—4 of FIG. 1 and looking in the direction of the arrows.

FIGS. 1, 2 and 4 show an assembled grille 10 constructed in accordance with the invention; all of the figures show the housing 12 within which the grille 10 is mounted: FIG. 4 additionally shows a loudspeaker 14 protected by the grille 10; FIGS. 2 and 4 best show the front and rear parts 16 and 18, respectively, of the grille; FIG. 1 shows mainly the front part 16; and FIG. 3 shows the rear part 18.

Obstruction means such as bars 20 and 22 are formed on the grille parts 16 and 18, respectively. These bars are substantially straight in a direction across the face of the grille and substantially U-shaped in cross section. One and only one leg, such as a leg 20*a*, of a U-bar of one part abuts one and only one leg, such as a leg 22*a*, of a U-bar of the other part to define a plurality of overlapping S curves. By the term "S curves" is meant curves having generally the shape of an S or a Z, as FIGS. 2 and 4 best illustrate. S or Z curves are seen, depending upon the direction in which the curves are viewed. In FIGS. 2 and 4, the curves have actually the shape of Zs, but they have the shape of Ss when viewed from the opposite side.

The curves overlap or form an imbricated structure so that the openings such as 24 in the part 16 are out of register with the openings such as 26 in the part 18. This provides a plurality of circuitous paths through the grille for the passage of sound or the like. However, there is no straight-line path through the grille for the passage of vandalizing implements or the like. Moreover, the S curves slope out and down as seen in FIGS. 2 and 4, so that they shed rain and the like.

In accordance with the invention, the parts 16 and 18 are substantially identical, which means that only one set of tooling is necessary to make both of the parts. The construction is such that the relationship described above with respect to the legs 20*a* and 22*a* and the openings 24 and 26 is established automatically when the parts 16 and 18 are placed together in back-to-back and head-to-toe relation. Thus, if FIG. 2 or 4 is viewed upside down, it can be seen that the bars 20 are identical to the bars 22. Or, to put it another way, if the parts 16 and 18 were separated and one part were rotated through 180° about an axis perpendicular to the plane of FIG. 2 or 4, it would be seen that the part so rotated had the same appearance as the other part.

Since the two parts 16 and 18 are the same as manufactured, it is a straightforward production matter to manufacture the grille 10 in volume. It is unnecessary to match the parts when they are manufactured, since any manufactured part is compatible with any other manufactured part.

The parts 16 and 18 can be held together in back-to-back and head-to-toe relation by any suitable fastening means. Preferably, the same fastening means which accomplishes this purpose also secures the assembled parts to the housing 12. In the preferred embodiment of the invention, the fastening means comprises four screws 28 which are blind tapped into the front grille part 16 and pass with a clearance through apertures 30 in the rear grille part 18. The screws 28 can thus be inserted and removed only from the rear, and are not accessible when the speaker with its protective grille is mounted in service against a support 32, as shown best in FIG. 4.

Between the mounting flange 36 of the housing 12 and the rear part 18 of the grille 10 and around each of the screws 28 is inserted spacer means 38 made of a non-resilient material such as phenolic resin.

The four spacers 38 contribute to a superior assembly. Without such spacers, the inner grille part 18 would bear against the speaker mounting ring 40 (FIG. 4), which is hard yet permanently compressible. This bearing force would not be uniform around the circumference of the speaker mounting ring 40 since the bars 22 of the rear grille part 18 extend horizontally and are not circular like the mounting ring. In the absence of the spacers 38, therefore, the tightening of the field installation mounting screws 42 would deform the mounting ring 40 nonuniformly, causing temporary distortion of, or permanent damage to, the speaker suspension. Malfunction or poor performance of the speaker would then result.

Moreover, because of the deformation of the speaker mounting ring 40 as indicated above, and depending on how much the installer tightened the screws 42, the speaker mounting ring 40 might continue to be compressed, eventually visibly distorting the grille 10.

The spacers 38 prevent this, since they have enough thickness that a slight clearance exists between the rear grille part 18 and the speaker mounting ring 40. The inner grille part 18 then bears firmly against these spacers 38 in four locations respectively near the corners of the grille part 18. This bearing force is transmitted to the speaker frame 43, allowing the sound producing elements to be free from any external mounting forces.

The screws 42 pass with a clearance through openings 46 and 48 in the front and rear grille parts 16 and 18, respectively. Dummy screws 50 of slightly larger diameter are tapped into the threaded openings 46, as FIG. 2 best shows. For field installation, two long screws 42 of relatively small diameter and two short dummy screws 50 of relatively large diameter are provided. That is because mounting boxes typically have only two threaded apertures such as 31 at opposite ends of one diagonal of the box. These apertures such as 31 may be in the upper left corner and lower right corner of the mounting box, or in the upper right corner and lower left corner of the box, depending on the way the box is oriented when it is installed. Since it is not known in advance where the threaded apertures 31 will be located, and since the grille should be mounted so that the S curves shed rain and the like, the installer decides at the time of installation where to locate the long screws 42 and where to locate the short dummy screws 50. The latter close the unused holes and provide a neat appearance for the completed installation.

The holes 30 and 48 through the rear grille part 18 are all clearance holes and, instead of being drilled, a single keyhole opening (not illustrated) in each corner of the rear grille part 18 can be provided in order to reduce the amount of machining necessary in preparation for assembly of the two grille parts 16 and 18.

Each part 16, 18 of the grille 10 preferably further comprises a plurality of straight, vertical bars B respectively connecting the horizontal bars 20, 22, the bars B of one part being in alignment with those of the other part when the two parts are assembled as described above.

Thus there is provided in accordance with the invention a novel and highly-effective grille adapted to protect loudspeakers and the like from rain, vandalizing implements, etc., while not interfering with the passage of sound. Indeed, the S curves are well adapted to reflect sound emanating from the speaker cone from the rear face of one S onto the front face of the next adjacent S and from there along the principal axis of propagation of the sound waves. The grille is obviously inexpensive to manufacture, since the two parts as manufactured are identical. Moreover, it is aesthetically pleasing and unobjectionable for mounting in office buildings, apartments, etc. Many modifications of the preferred embodiments of the invention described herein will readily occur to those skilled in the art upon consideration of this disclosure. Accordingly, this invention is to be construed as including all of the embodiments which are within the scope of the appended claims.

I claim:

1. In combination, (a) a grille for protecting a loudspeaker or the like and (b) loudspeaker housing means, the grille comprising two parts, each being formed with obstruction means defining a plurality of openings, the structure being such that, when the two parts are placed together in back-to-back and head-to-toe relation, the openings in one part are out of register with the openings in the other part and a plurality of circuitous paths are provided through the grille for the passage of sound or the like, there being no straight-line path through the grille for the passage of vandalizing implements or the like, the two parts being characterized in that they are substantially identical, and the loudspeaker housing means being separate from the grille, further comprising (c) removable fastening means for attaching the two parts of the grille to each other and for attaching the grille to the loudspeaker housing means.

2. A grille for protecting a loudspeaker of the like comprising two parts, each being formed with obstruction means defining a plurality of openings, the structure being such that, when the two parts are placed together in back-to-back and head-to-toe relation, the openings in one part are out of register with the openings in the other part and a plurality of circuitous paths are provided through the grille for the passage of sound or the like, there being no straight-line path through the grille for the passage of vandalizing implements or the like, the two parts being characterized in that they are substantially identical, wherein the obstruction means in each part comprises a plurality of bars that are substantially straight in a direction across the face of the grille and that are substantially U-shaped in cross section, one and only one leg of a U of one part abutting one and only one leg of a U of the other part to define a plurality of overlapping S curves.

3. A grille according to claim 2 wherein the S curves slope out and down to shed rain and the like.

4. A grille according to claim 1 further comprising spacer means inserted around the fastening means between the grille and the housing means, the spacer means being made of a non-resilient material.

5. A grille according to claim 4 wherein the spacer means is made of a phenolic resin.

6. A grille according to claim 2 wherein each part further comprises a plurality of straight, vertical bars respectively connecting the bars of U-shaped cross section, the vertical bars of one part being in alignment with those of the other part.

7. A grille for protecting a loudspeaker or the like comprising two parts, each being formed with obstruction means defining a plurality of openings, the structure being such that, when the two parts are placed together in back-to-back and head-to-toe relation, the openings in one part are out of register with the openings in the other part and a plurality of circuitous paths are provided through the grille for the passage of sound or the like, there being no straight-line path through the grille for the passage of vandalizing implements or the like, the two parts being characterized in that they are substantially identical, further comprising housing means, fastening means for attaching the grille to the housing means, and spacer means inserted around the fastening means between the grille and the housing means, the spacer means being made of a non-resilient material, and further comprising two mounting screws for attaching the grille and housing means to a support and two dummy screws, the grille and housing means being formed with four sets of apertures, the mounting screws respectively passing through two sets of apertures and the dummy screws respectively closing off the other two sets of apertures.

* * * * *